United States Patent [19]

Ljokkoi

[11] Patent Number: 5,000,842

[45] Date of Patent: Mar. 19, 1991

[54] METHOD AND APPARATUS FOR TREATING FIBER SUSPENSION

[75] Inventor: Risto A. Ljokkoi, Kotka, Finland

[73] Assignee: A. Ahlstrom Corporation, Karhula, Finland

[21] Appl. No.: 512,519

[22] Filed: Apr. 19, 1990

Related U.S. Application Data

[63] Continuation of Ser. No. 184,427, Apr. 21, 1988, abandoned.

[30] Foreign Application Priority Data

Apr. 30, 1987 [FI] Finland ..... 871928

[51] Int. Cl.[5] ..... B07B 1/20

[52] U.S. Cl. ..... 209/273; 209/306; 210/415

[58] Field of Search ..... 209/270, 273, 268, 303–306, 209/397, 380; 210/413, 414, 415; 162/55

[56] References Cited

U.S. PATENT DOCUMENTS

| | | | |
|---|---|---|---|
| 1,921,750 | 8/1933 | Heinrich et al. | 209/273 |
| 3,011,220 | 12/1961 | Keller et al. | 209/283 |
| 3,363,759 | 1/1968 | Clarke-Pounder | 209/273 |
| 3,400,820 | 9/1968 | Nelson | 209/273 |
| 3,437,204 | 4/1969 | Clarke-Pounder | 209/273 |
| 3,713,541 | 1/1973 | Nelson | 209/273 X |
| 3,939,065 | 2/1976 | Einarsson | 209/270 X |
| 4,111,373 | 9/1978 | Holz | 209/273 X |
| 4,165,841 | 8/1979 | Musselmann et al. | 209/211 |
| 4,188,286 | 2/1980 | Holz | 209/273 |
| 4,202,761 | 5/1980 | Holz | 209/273 |
| 4,234,417 | 11/1980 | Gauld et al. | 209/273 X |
| 4,238,324 | 12/1980 | Musselmann et al. | 209/273 X |
| 4,356,085 | 10/1982 | Schon et al. | 209/273 |
| 4,374,728 | 2/1983 | Gauld | 209/273 |
| 4,447,320 | 5/1984 | Lamort | 209/273 |
| 4,529,520 | 7/1985 | Lampenius | 204/397 |
| 4,832,832 | 5/1989 | Fujiwara et al. | 209/273 |
| 4,836,915 | 6/1989 | Frejborg | 209/273 |

FOREIGN PATENT DOCUMENTS

| | | | |
|---|---|---|---|
| 046687 | 5/1982 | European Pat. Off. . | |
| 579606 | 6/1933 | Fed. Rep. of Germany . | |
| 2850385 | 7/1980 | Fed. Rep. of Germany . | |
| 3033217 | 4/1981 | Fed. Rep. of Germany . | |
| 3607457 | 9/1987 | Fed. Rep. of Germany | 209/273 |
| 2050187 | 11/1981 | United Kingdom . | |

*Primary Examiner*—Donald T. Hajec

*Attorney, Agent, or Firm*—Nixon & Vanderhye

[57] ABSTRACT

Fiber suspension, such as paper pulp flowing to the headbox of a paper machine, is acted upon by apparatus which affects the axial direction and magnitude of the speed of the fiber suspension during screening to optimize results. A rotor cooperates with a screen cylinder, the rotor having a plurality of projections arranged along its axial length. The axial length of the rotor preferably has different axially extending circumferential zones. The projections have non-axial surfaces which act on the suspension to change the axial forces. Different shapes of projections are preferably provided in the different zones so that the axial forces vary in dependence upon the distance from the inlet to the screen casing, and the discharge outlet from the screen casing.

8 Claims, 7 Drawing Sheets

METHOD AND APPARATUS FOR TREATING FIBER SUSPENSION

This is a continuation of application Ser. No. 07/184,427, filed Apr. 21, 1988, now abandoned.

BACKGROUND OF THE INVENTION

The present invention relates to a method and apparatus for treating fiber suspension. The method according to the invention is particularly suitable in screening pulps of the wood processing industry. The apparatus according to the invention relates to a rotor and a screen construction of the power screen to be used.

According to the prior art there are, in principle, two different types of rotor arrangements which both are commonly used and the intention of which, as known, is to maintain the screen surface clean, in other words to prevent the formation of a fiber mat on the screen surface. An example of one type is a rotor arrangement disclosed in the U.S. Pat. No. 4193865 in which a rotor is arranged inside a cylindrical, stationary screen cylinder. The rotor comprises foils located close to the surface of the screen cylinder, which in a construction in accordance with said patent form an angle with the shaft of the cylinder. When moving the foils subject the screen surface to pressure pulses which open the perforations of the surface. There are also arrangements in which the foils are located on both sides of the screen cylinder. Respectively, also the pulp can be fed either to the inside or the outside of the cylinder and the discharge of the accept can take place either from the outside or the inside of the cylinder.

An example of the other type of rotor arrangement is in accordance with the U.S. Pat. No. 3437204, in which the rotor is substantially a cylindrical closed body, on the surface of which there are protrusions almost hemispherical in form. In this kind of apparatus pulp is fed between the rotor cylinder and the screen cylinder outside it, whereby the bulges of the rotor, the so called bumps, act both to press the pulp against the screen cylinder and to draw off the fiber flocks with the trailing edge off the perforations of the screen cylinder. Because this kind of construction has a highly thickening effect on the pulp, there are in the above mentioned arrangement three dilution water connections arranged at different heights on the screen cylinder, so as to make the screening of fiber suspension take place satisfactorily. A corresponding type of a "bump rotor" is disclosed also in the U.S. Pat. No. 3363759, in which the rotor is slightly conical for the reason described further below.

Additionally, other embodiments of the above mentioned cylindrical rotor are known and in connection with which there are intended to be used many kinds of protrusions in the screen cylinder side as disclosed in different publications.

DE application 3006482 discloses a knot separator in which on the surface of a cylindrical rotor drum there are plough like protrusions, made of plate material, by which the pulp between the rotor and the screen cylinder is subjected to strong mixing forces so as to make fibers pass through the screen cylinder most effectively, shives and such separate therefrom.

U.S. Pat. Nos. 4188286 and 4202761 disclose a screen apparatus in which there is a rotable cylindrical rotor inside the screen cylinder. There are protrusions arranged on the rotor on the screen cylinder side, which protrusions have a V-shaped axial cross section such that there is a surface coming closest to the screen cylinder and being parallel to the rim of the rotor, and an end surface substantially perpendicular to the surface of the rotor. These protrusions are arranged on the surface of the rotor cylinder axially in a certain angle position so that all protrusions of the rotor are in the same disposition with respect to the shaft of the rotor.

According to the prior publications pulp can be fed to this apparatus to either side of the screen cylinder. If pulp is fed to the outside of the screen cylinder and accept is discharged from the interior of the screen cylinder, in other words from the rotor side, the rotational direction of the rotor is such that the accept is subjected by the angle position of the protrusions to a force component directed downwards and that the said inclined/ascending surface operates as a front surface. If, however, pulp is fed between the rotor and the screen cylinder, in other words the accept is discharged from exterior of the screen cylinder, the rotational direction is opposite to the former. The protrusions tend to slow down the downward pulp flow and the surface upright to the surface of the rotor cylinder operates as a front surface.

Practical experience in the industry has, however, shown that the above mentioned apparatus arrangements do not operate satisfactorily in all circumstances. For example, the first mentioned foil rotor produces too strong pressure pulses on the accept side of the screen cylinder and is thus not applicable, for example, with the head boxes of paper machines where there are to be no fluctuation of pressure in the suspension. The apparatus also tends to dilute the accept and is therefore not applicable in cases where pulp with constant consistency is needed. Because the foils in the foil rotors are considerably far apart (4 to 8 foils), fiber matting will always form on the screen cylinder before the next foil wipes it off. Thus the use of the screen is not efficient. Additionally, the said rotor type is expensive to produce because of the accurate dimensioning requirements of the rotor and the careful finishing of it.

A substantially cylindrical rotor, described as another model, has protrusions almost hemispherical in form and operates in some circumstances almost ideally, but, for example, in connection with a head box of a paper machine, further claims can be set for its operation. Because the pulp coming to the head box should be of uniform quality in both consistency and in the size of fibers, the power screen should not adversely affect such quality. However, this kind of "bump rotor" tends to dilute the accept and also causes fluctuation in the consistency values. In the performed tests it was noted that a formerly mentioned type of rotor diluted accept in the limits of −0,15 to −0,45% the desired consistency of accept being 3%. Consequently, the consistency ranges, if absolutely calculated, ±5% which is too much, when a homogeneous and qualified end product is to be gained. On the other hand, in the screen which comprises a "bump rotor" fractionation also takes place, in other words the mutual relation between the fractions of the fiber suspension fed into the screen cylinder changes in the screen in the way that the relation of the fractions of the accept is no more the same as that of the originally fed pulp. With the "bump rotor" the rate of change of the fractionation has been noted to range between 5 to 10 per cent depending on the clearance between the rotor and the screen cylinder. A corresponding rate of change with the foil rotor was about 20 per cent, thus the bump rotor is already a considerable improvement compared to the earlier apparatuses.

These above described defects of a screen apparatus including a "bump rotor" have led to some attempts at improvement, of which conduction of dilution water to the screen surface and in another case a slightly conical form of the rotor have already been mentioned above. Both methods above reflect a problem arising in connection with a cylindrical rotor, namely unevenness of the screen cylinder use in its different zones. The fact is that the greatest flow through the screen cylinder takes place immediately after the pulp has entered into contact with the cylinder and the rotor. Thus the pulp to some extent thickens and while pulp is flowing down along the screen surface, the amount of suspension passing through the screen perforations reduces constantly. Attempts have been made to prevent this by feeding dilution water at different heights in the screen surface, which results to some extent in a more effective operation of the screen cylinder, but has the drawback of a considerable dilution of the accept. It is also possible to use differing clearance between the screen cylinder and the rotor, whereby a larger clearance of the upper part of the screen apparatus permits a greater downward speed for the pulp with the pulp thus better and more evenly filling said clearance.

A similar manner of operation can also be seen in the arrangement of the U.S. Pat. No. 4188286, in which the protrusions are inclined with respect to the shaft of the screen cylinder. The main purpose of the inclination is to prevent the fibers or fiber flocks from sticking on the front surface of the protrusion and drifting along with it. A secondary purpose is to subject a downward force component to the accept pulp between the rotor and the screen cylinder, which component accelerates the operation of the screen apparatus, or at least the discharge of accept from the screen.

FIG. 1 illustrates typical velocity distribution in a screen apparatus with a cylindrical rotor. The left side of the figure shows the change of axial velocity component $V_f$ of the pulp as a function of the height of the screen cylinder. The right side of the figure, on the other hand, shows the change of velocity component $V_z$ of the suspension flowing through the perforations of the cylinder. The graphs could as well show the change in the volumetric flow, whereby it could be seen that with a conventional arrangement 50 per cent of the accept passes through the perforations of the screen cylinder in the upper quarter of the cylinder and respectively 80 per cent of the accept in the upper half of the cylinder. The theoretical maximum capacity of the screen cylinder is, in use, immediately after the upper edge almost one fifth of the total height of the cylinder. Thereafter the pulp flow which has passed through the cylinder radically reduces due to the radical reduction of the velocity component $V_f$ to less than half of its maximum value in the upper fifth of the cylinder. The reason for this is, of course, both because of the increase of the horizontal velocity component of the pulp due to the effect of the rotor and also thickening of the pulp to some degree between the rotor and the screen cylinder.

Additionally, the right side of the figure shows that only half of the theoretical maximum capacity of the screen cylinder is available for use, while if it were possible to maintain the same velocity through the screen perforations throughout the whole cylinder the graph would be a rectangle and not a curve as in the figure. In reality the capacity is restricted by the amount of reject relatively increasing in the pulp, but only from the middle part of the screen cylinder onwards.

Thus it can be observed that it is possible to increase the capacity of the screen cylinder if the axial velocity of the pulp flowing between the rotor and the screen cylinder can be maintained considerably high and if the pulp can be kept respectively longer in the middle part of the cylinder. FIG. 2 is a graph showing the corresponding distributions as in FIG. 1 for an apparatus in accordance with the invention, whereby it is noted that the axial velocity and respectively also the axial volumetric flow decreases much more slowly than in a conventional arrangement. In other words the velocity $V_f$ has reduced to half of its initial value as late as in the middle part of the screen cylinder. The result of this has been that the screen velocity $V_z$ of the perforations of the screen cylinder has reduced in the upper part of the cylinder due to lesser pressure against the cylinder, but respectively the speed remains constant almost until the middle part of the screen cylinder, wherefrom it evenly reduces but not, however, reducing to zero as in the conventional apparatuses. Thus with this kind of apparatus it is possible to increase the feeding rate, which corresponds the axial velocity $V_f$, because the maximum screen capacity of the screen cylinder is not yet in use. By such operation the distribution shown in broken lines in FIG. 2 is achieved, which raises the capacity of screen cylinder, roughly speaking, to almost 50% higher.

These results have been achieved by the method in accordance with the invention, characterized in that fiber suspension is additionally subjected to axial forces changing in intensity and effective direction, the direction and intensity of which are determined on the basis of the axial position between the point of application and the counter surface of the screen cylinder and with which the axial speed contour of fiber suspension is changed yet maintaining the flow direction constantly towards the discharge end.

The apparatus according to the invention is, on the other hand, characterized in that at least on one of the said counter surfaces facing another surface there is at least one bulge or corresponding contour or other projection, the direction of the leading or front surface of which varies according to the axial position of the bulge and by which the pulp particle is subjected to an axial force component, the intensity of which varies as a function of the position of the pulp particle in the axial direction, and which changes the speed contour of the fiber suspension flowing between the counter surfaces.

The method and apparatus according to the invention are described in detail below, by way of example with reference to the accompanying drawings, in which:

DETAILED DESCRIPTION OF THE DRAWINGS

Figure 3:
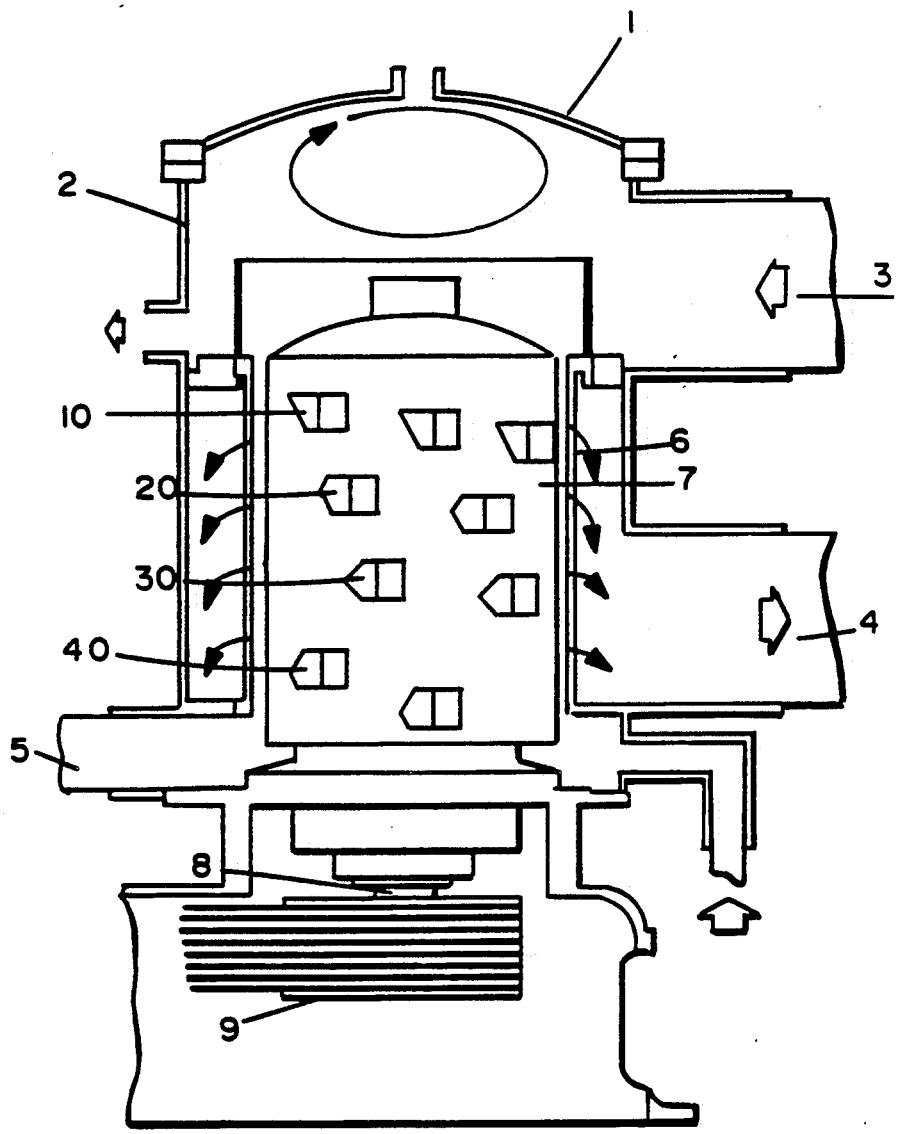
FIG. 3 is a part sectional view of a preferred embodiment of a screen apparatus according to the invention.

A screen apparatus 1 in accordance with a preferred embodiment of the invention is illustrated in FIG. 3 comprising an outer casing 2, duct connections 3, 4 and 5 for the incoming pulp, accept and reject in the casing 2, a stationary screen cylinder 6, inside of which is located a substantially cylindrical rotor 7 having a shaft 8 with actuator 9. The screen cylinder 6 can be in principle of any of the previously known types, but the best results can be achieved by using a contoured screen cylinder. The accept which has passed through the perforations of the screen cylinder is discharged via the connection 4 and through the space between the screen cylinder 6 and the rotor 7 out of the bottom of the space and therefrom the pulp that has passed through is discharged via the reject connection 5.

It can also be seen in FIG. 3 that on the surface of the rotor on the screen cylinder 6 side, there are arranged bulges 10–40, the form of which varies according to the zone they are located in the axial zones of the rotor.

Figure 4:
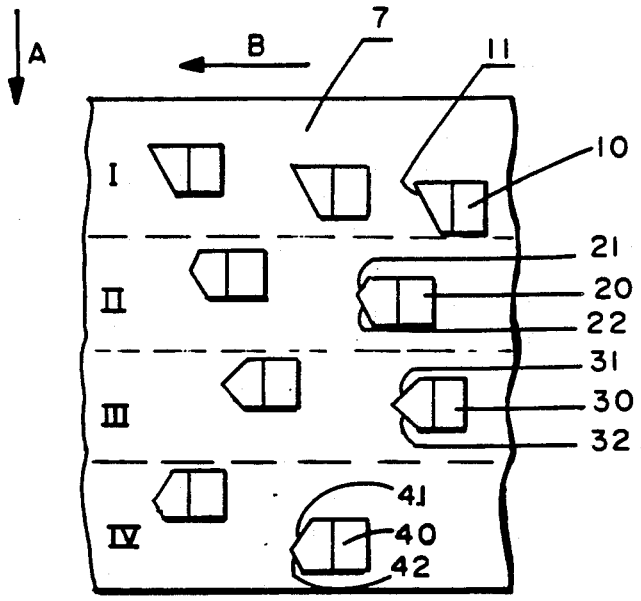
FIG. 4 is a fragmentary detail comprising a development (flattened elevation) of a rotor arrangement in accordance with a preferred embodiment of the invention.
Figure 5A:
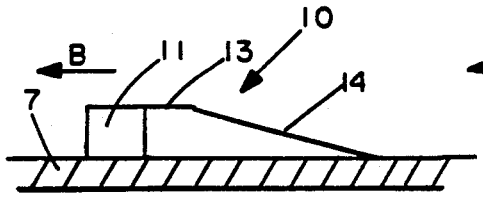
FIGS. 5 *a–d* show side views of the bulges of a preferred embodiment in accordance with the invention.

FIG. 4 is a fragmentary detail comprising a development of part of the rotor 7 whereby the form, position and way of operation are better illustrated. In the incoming direction A of the fiber suspension the first protrusion, of which there are a plurality in zone I, is a so called pumping projection or bulge 10, the front surface 11 of which is inclined with respect to the direction of the shaft of the cylinder in such a way that due to the rotational direction of the cylinder the pulp is subjected by the the front surface 11 not only to a tangential force component but also to an axial force component pumping the pulp towards the middle part of the cylinder. One such bulge 10 is shown in FIG. 5*a* wherein it can be seen that in the arrangement according to this preferred embodiment, the front surface 11 of the bulge 10 is substantially upright against the surface of the rotor 7. In the bulge 10 there is a part 13 substantially parallel to the surface of the rotor 7 and, from the part 13 descending towards the surface of the rotor 7 an inclined surface 14.

Figure 5B:
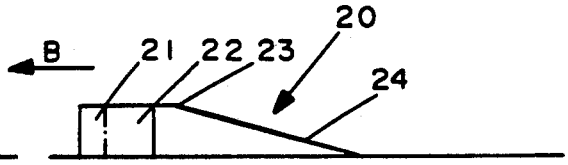

Each of a second group of protrusions in a second zone II, comprises a bulge 20 the front surface of which is divided into two parts 21 and 22 forming a plough-like surface with each other. The part 21 in the embodiment of the figure slows down to some extent the axial flow A of the pulp and, respectively, the part 22 intensifies the flow. By adjusting the length and the angle positions deviating from the axial direction it is possible to influence the total effect the bulges 20 have on the the pulp flow. In the case in accordance with the figure, the effect is a slightly pumping action. In the side view of FIG. 5*b* it can be seen that each bulge 20 generally corresponds in form to the bulge 10; the only differences being in the front surface.

Figure 5C:
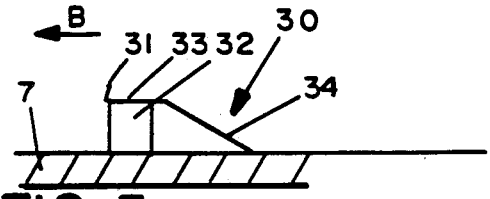

The third protrusions which are in zone III, each comprise a bulge 30 the front surface of which is also divided into two parts 31 and 32 which in the embodiment illustrated are symmetrical about the mid-line of the bulge 30. The purpose of these parts is only to give pulp tangential velocity without actively influencing the change of the axial velocity. As FIG. 5*c* shows, the side view of the protrusion is generally similar to that of the previous versions.

Figure 5D:
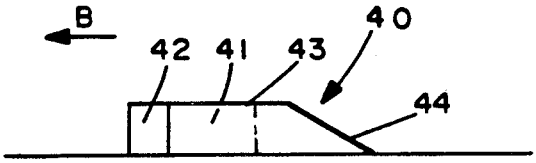

The fourth protrusions in zone IV, each comprise a bulge 40 the front surface of which is again divided into two parts 41 and 42, of which now the part 41 on the flow inlet of upstream side influences the pulp flow more to cause a slowing-down, in other words with the intention of keeping the pulp longer between the rotor and the screen cylinder. According to FIG. 5*d*, the side view differs from the previous ones in zone II only in the front surfaces. Otherwise the cross section, form and operation are generally disclosed in the previous description. The screen cylinder is subjected by the steep front surface to a pressure pulse which presses the accept through the perforations of the cylinder and the inclined end surface detaches larger particles and fiber flocks stuck on the apertures thus clearing the screen cylinder. It is to be noted concerning the location of the bulges that when the rotor is rotating they form a uniform continuous enveloping surface or that they are located when using a contoured slotted screen cylinder at the slot lines parallel to the rim of the cylinder thus ensuring the clearing of the slots, but avoiding the unnecessary wiping of the surface between the slot lines.

FIG. 4 thus illustrates a screen divided into four different zones according to the operation. The division is based on the operational effect of the bulges 10–40 on the pulp being treated. In the zone of the bulges 10 the pulp is axially pumped at full capacity. In the zone of the bulges 20 the pumping continues at lesser capacity because the intention is to maintain the pulp longer in the middle part of the screen cylinder. Also bulges 30, which merely mix the pulp, and bulges 40, which slow down the natural axial speed of the pulp, serve this purpose. Consequently, the operational zones in the embodiment of FIG. 4 are I intensively pumping, II slightly pumping, III neutral effect and IV a decelerating zone.

In addition to the zones shown above it is possible to provide an additional, intensive pumping zone similar to the zone I as a fifth zone downward of zone IV, where protrusions similar to bulges 10 are used. Thus the reject pulp will not completely clog the discharge openings of the screen cylinder.

Figure 6:
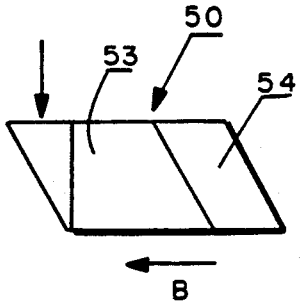
FIGS. 6 and 7 are side elevations of bulge arrangements according to a second preferred embodiment of the invention.
Figure 7:
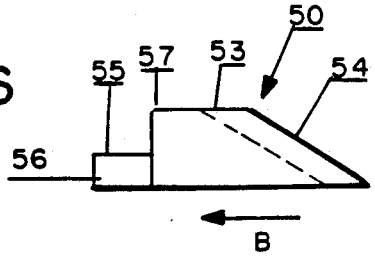

FIGS. 6 and 7 show bulge arrangements of another embodiment, in which the bulges 50 in all zones are in principle similar in plan. In bulges 50 there is a top surface 53 substantially parallel to the surface of the rotor 7 and an end surface 54 descending from it towards the surface of the rotor 7. The front surface of the bulge 50 is, however, divided into two parts 56 and 57 on a plane parallel to the surface of the rotor, of which part 56, located closer to the surface of the rotor is arranged to operate as a pumping part and the outer part 57 of the front surface is arranged to operate as a clearing part. Between these parts there is a plane part 55 substantially parallel to the plane of the rotor. The operation of these bulges is adjusted by changing the relationship of the heights of parts 56 and 57 of the front surface, in other words the relation of the height $h^1$ of the transferring part 56 to the height of the whole bulges 50. The smaller the relation $h^1/h$ is, the more neutrally the bulge works. As the relation $h^1/h$ grows, the pumping effect of the bulge intensifies.

Although part 57 is shown in the figures axially extending, it is, of course, possible for it to be slightly inclined with respect to said direction. Neither do parts 56 and 57 necessarily have to be perpendicular to the surface of the rotor 7, but they can form either an acute or obtuse angle with it. The most important consideration is that the operation of the bulges remains as described above and that the flow speed distributions in accordance with FIG. 2 can be achieved.

Figure 1:
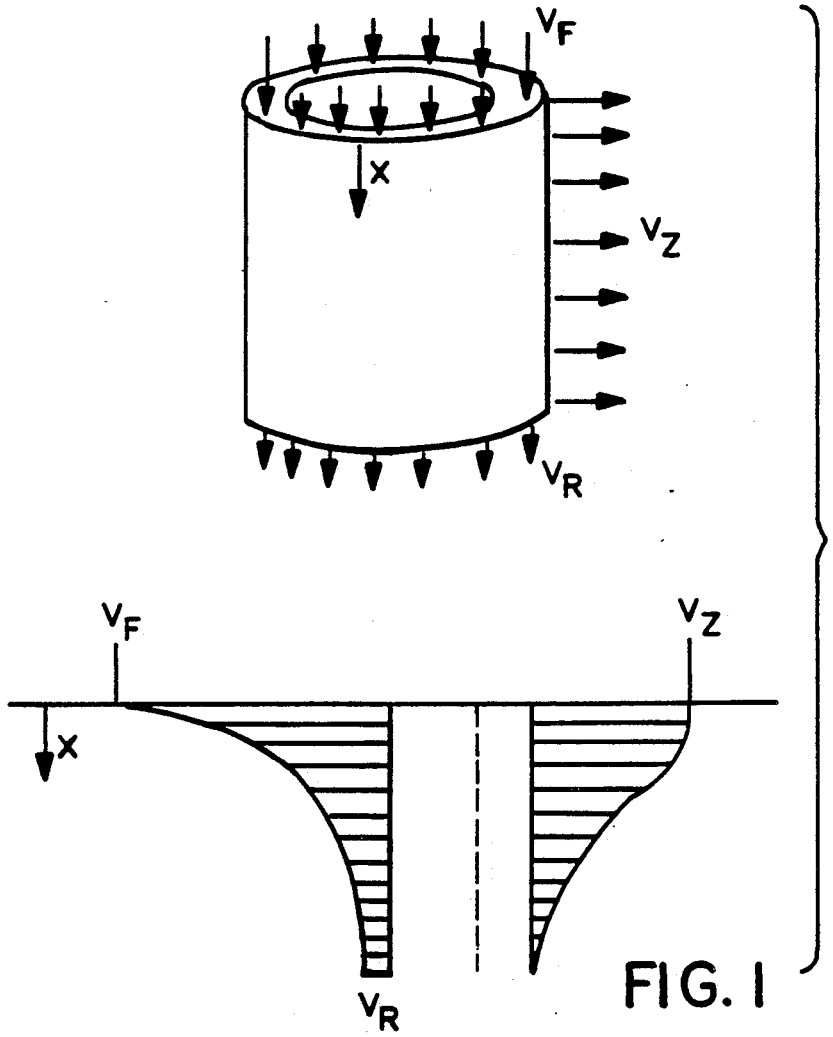
FIG. 1 is, as already mentioned above, a graph showing flow rate distributions of pulp of a screen cylinder also schematically illustrated with a conventional cylindrical "bump rotor" both in the axial direction and through the perforations of the screen cylinder.
Figure 2:
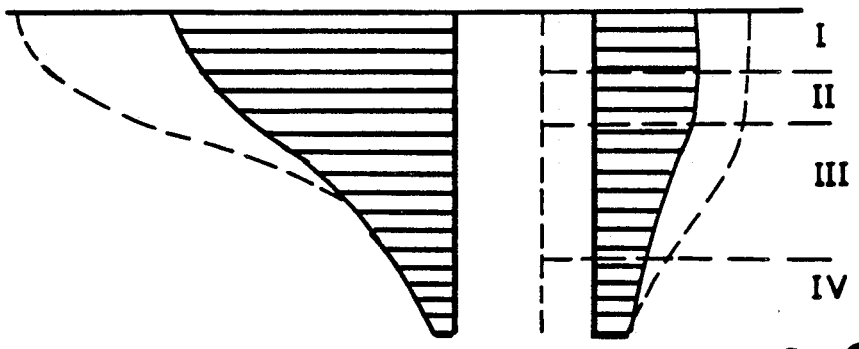
FIG. 2 is a graph similar to that of FIG. 1 showing the corresponding distributions of a screen apparatus with a rotor in accordance with the invention.

In FIG. 2 the boundaries of the different zones are represented by a broken line. It is noted therefrom that by the pumping of the first and second stage a considerably even rate of flow through of the screen cylinder can be maintained and which begins to reduce only in the region of the third zone. In the end of the third zone and in the fourth zone the biggest difference compared to the earlier technique is to be seen, because the decelerating bulges can maintain the fluid flow through the screen cylinder considerably high as far as the edge of the cylinder. Respectively, when comparing the FIGS. 1 and 2 one notes that the curves on the left hand side showing the distribution of the axial velocities completely differ from each other in form. With the arrangement according to the invention almost linear reduction of speed is achieved, from which one can draw the conclusion that the apparatus operates on the whole extremely well and effectively, because the graph at the same time shows the change in the volumetric flow in the space between the rotor and the screen cylinder. Thus it has been possible to widen the range of use significantly with respect to the prior art, the result of which is the increase in the actual total capacity of the screen cylinder, if the feed speed of pulp is increased.

Figure 8:
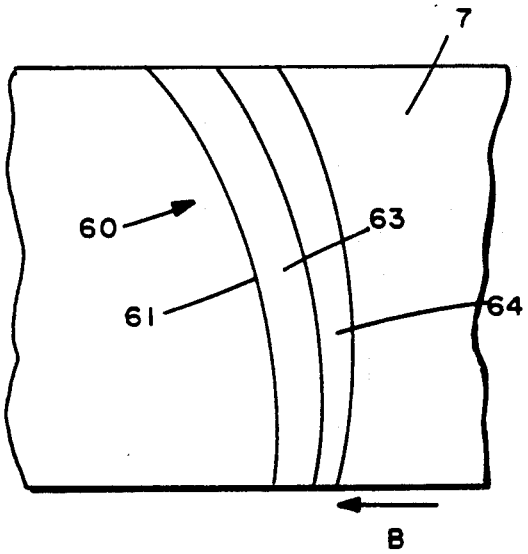
FIG. 8 is a fragmentary development (fragmentary elevation) of a rotor arrangement in accordance with a second preferred embodiment.

In the embodiment shown in FIG. 8 there is attached or otherwise arranged a rib-like bent or curved protrusion 60 which comprises all the components and modes of operation characteristic of also all the previous protrusions. The front surface 61 forms an acute angle with the rotor surface; advantageously, the front surface is perpendicular to the rotor plane. There is also a part 63 parallel to the surface of the rotor 7 in the protrusion 60 and an end surface 64 descending inclined from the above mentioned part to the plane of the rotor surface.

Figure 9:
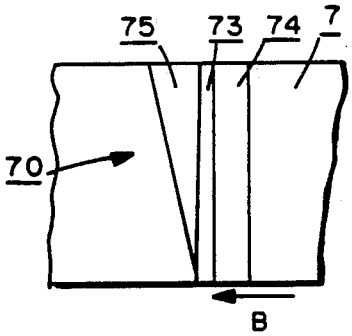
FIG. 9 is a fragmentary detail development of a rotor arrangement in accordance with a third preferred embodiment.
Figure 10:
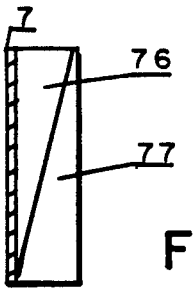
FIG. 10 is an elevation of the front surface of a bulge of the rotor arrangement according to FIG. 9 from the view point of the tangent of the rotor.
Figure 11:
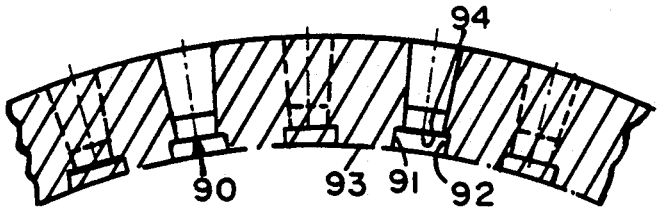
FIGS. 11–19 are fragmentary sections of different contour arrangements for the screen cylinder, and FIG. 20 schematically illustrates yet another preferred embodiment of the invention.

The rib-like protrusion 60 can either be similar to the one shown in the figure, in which case the angle between the top of the bulge and the axial direction of the rotor determines the intensity of the pumping. Respectively, the radius at bend of the protrusion or its speed of change determine the actual effects on the pulp between the rotor and the screen cylinder. The direction of the rib-like protrusion in FIG. 9 turns to slightly resist the downward flow bringing about a similar decelerating effect as the bulge 40 of the rotor according to FIG. 4. Another alternative is, of course, that the rib-like protrusion of the rotor changes its direction one more time pumping, as the last stage, the pulp out of passage between the rotor and the screen cylinder. Consequently, the protrusion is in form curved in two directions, forming in other words a mirror image of a slightly curved S-letter. In the embodiment shown in FIGS. 9 and 10 the rib-like protrusion extends principally axially in direction. Only the part 76 of the front surface deviates from the axial direction. The construction is, in principle, the same as in bulges of FIGS. 6 and 7 with a two-piece front surface. As with the other types of bulges, there is also in this type a part 73 parallel to the rotor surface and an inclined end surface 74. The leading or front surface is divided into two in plane 75: part 76, the direction of which differs from the axial direction and part 77, the direction of which is axial. The height of the part 76 from the rotor surface is at its most at the upper edge of the rotor, whereby also the suction effect of the rotor is at its most. The height of the part 76 reduces either linearly, as shown in FIG. 10, or curvingly to the requested direction. Thus it is possible to optimize both the intensity of the pumping effect and its duration. If the height of the part 76 is at its minimum at the lower edge of the rotor, no intensive pumping takes place in the discharge direction, but no deceleration of flow either. If pumping to the discharge direction is required, the height of the part 76 can be raised in the lower end.

If the decelerating effect is also required in the pulp flow, it is possible to arrange the part 77 of the front surface to be inclined backwards, in other words, inclined in the opposite direction, thus the relation of the heights of the parts of the front surface determines the total effect of the front surface to the pulp flow.

Figure 12:
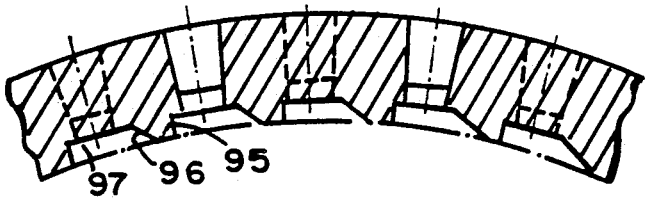
Figure 13:
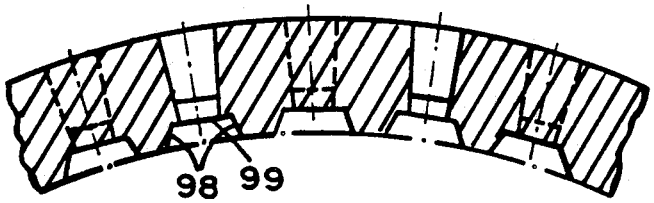
Figure 14:
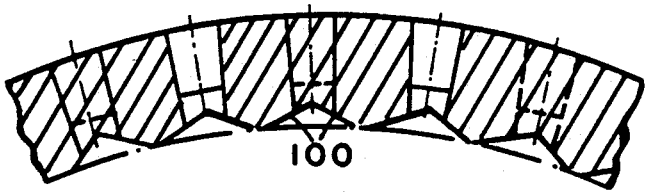
Figure 15:
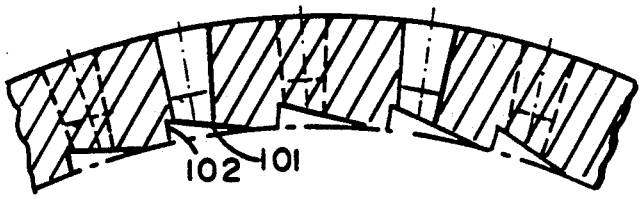
Figure 16:
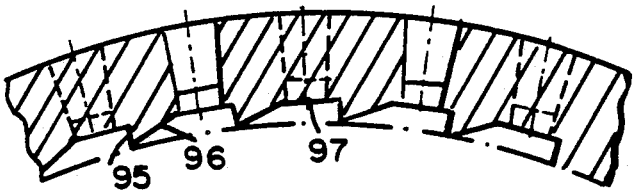
Figure 17:
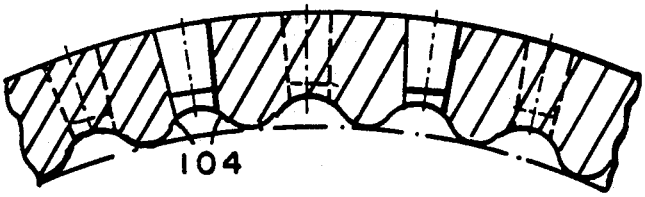
Figure 18:
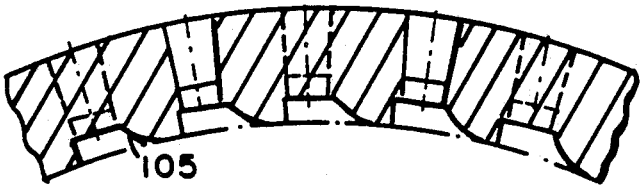
Figure 19:
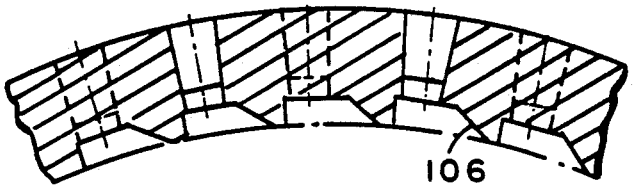

The rotor according to the invention is suitable for use in connection with plain as well as slotted screen cylinders. Thus the screen cylinder can be either completely plain or slotted in different ways, as illustrated in FIGS 11–19. The slots 90 can be arranged either with two surfaces 91, 19 perpendicular to the casing surface 93 and a bottom surface 94, FIG. 11; with a surface 95 perpendicular to the bottom surface 97, and an inclined surface 96; FIG. 12; with two inclined surfaces 98 and a bottom surface 99; FIG. 13; with two inclined surfaces 100, and no bottom surface; FIG. 14; or with an inclined surface 101 and a surface 102 perpendicular to the casing surface, and no bottom surface; FIG. 15; FIG. 16 is identical to FIG. 12 only the surfaces 95, 96 are switched. Respectively, there can be in the screen cylinder a part connecting with the casing surface, as e.g. in FIGS. 11, 12, 13, and 15, or the connection can be just a linear part, as e.g. in FIGS. 14, 16 or 17. Additionally, planar parts can be replaced by curved parts, as shown e.g. in FIGS. 17, 18 and 19 having curved surfaces 104, 105, and 106, respectively. Furthermore, the rotational direction of the rotor can vary with respect to the cylinder, in other words the pulp flow can be in either direction.

It is, of course, possible to create corresponding flow characteristics with a screen cylinder—rotor combination by producing either the cylinder or the rotor or both of contour plate and axially, for example, of four separate parts, in which the direction of the contouring changes in such a way that a corresponding operation is brought about. Thus the method and apparatus according to the invention are characterized in that the rotor is of a previously known type and the screen cylinder is a new type in construction. In addition to that it is also possible to arrange a rotational screen cylinder and a stationary counter surface to it.

Figure 20:
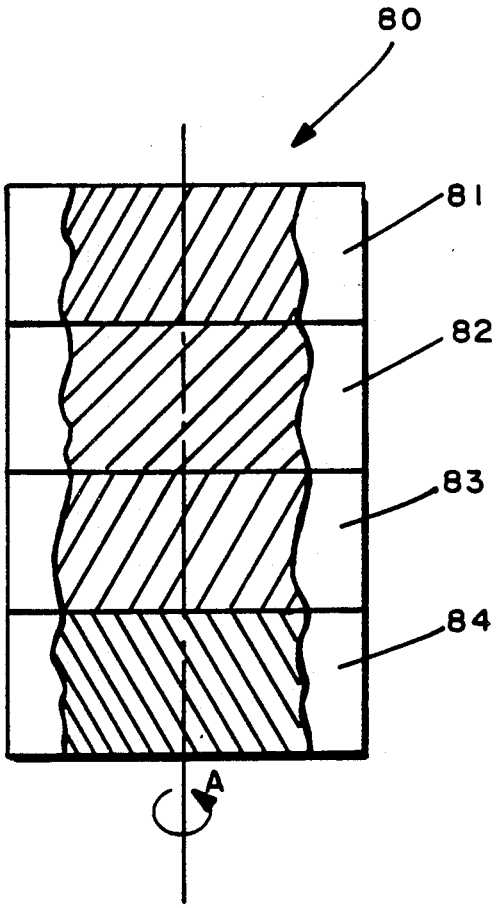

FIG. 20 illustrates an arrangement, in which the screen cylinder contour is of one of the types shown in FIGS. 11-19. As is to be noted in FIG. 20, the cylinder 80 comprises four cylindrical zones i.e. parts 81, 82, 83, and 84, in which the direction of the slots vary. The rotational direction of the rotor is to be parallel to arrow A, whereby the slotting of the uppermost ring 81 is such that it intensively draws pulp to the screening zone, that of the ring 82 is such that there is less suction, that of the ring 83 is neutral and the slotting of the ring 84 decreases the discharge flow.

Thus new rotors can be applied to old fashioned or existing screen cylinders and vice versa by the arrangements according to the invention. The result is a screen cylinder—rotor combination which operates better than the previous known arrangements.

In the tests performed a rotor arrangement according to the invention was tested in connection with different screen cylinders and different rotors were compared with each other. The cylinders used as screen cylinders in the tests were flat or made of contour plates. After examining the results of the tests it was to be noted that the apparatus according to the invention operates with all screen cylinders more effectively than the other rotors. The difference was even clearer when using a slotted cylinder, of which cylinders stood out the type seen in FIG. 12, whereby the rotational direction of the pulp was from the right to the left. In other words, according to the tests the most preferred embodiment was a cylinder, the slots of which were formed by a bottom surface substantially parallel to cylinder casing, a gradient side surface on the upstream side, i.e. the income direction of the flow, and a side surface substantially perpendicular to the cylinder casing on the downstream side.

As becomes clear from the description, the method and apparatus according to the invention have enabled the elimination or minimization of the defects of the methods and apparatuses of the prior art and at the same time it has been possible to considerably raise the maximum capacity of the screen device. It is, however, to be noted that the above description discloses only a few of the most important embodiments of our invention and we have no intention to restrict our invention to anything less than that within the scope of the the accompanying claims which determine the scope of protection sought.

EXAMPLE

The comparison rotors used in the tests were, as common in the pulp and paper industry, foil rotors and "bump rotors", which have already been referred to in the prior art. The dimensions of the rotor according to our invention were $\phi$ about 590 mm $\times$230 mm. The main dimensions of the bulges were 15$\times$50$\times$50 mm and the gradients of the surface (14, 24, 34, 44) with respect to the rotor surface was 30°. The gradients of the front surface of the bulge 10 with respect to the axial direction was 15°. The front surface of the bulge 20 was divided into two parts, of which the axial length of the piece 21 was 17 mm and that of the piece 22 was 33 mm and the angles of deviation from the axial direction were 15°. The front surface of the bulge 30 was divided into two parts and the angles of deviation as in the previous case were 15°. The bulge 40 was a mirror image of the bulge 20, whereby the axial length of the front surface of the piece 41 was 33 mm and that of piece 42 17 mm. The angles of deviation were still 15°.

In the test rotor the bulges were attached in such a way that there were 4 of the bulges 10, 4 of bulges 20, 9 of bulges 30, and 4 of bulges 40. The load used with all rotor versions in the tests was 100 t/d, whereby the results are best to be compared with each other. The table below shows the test results:

| Parameters being compared | Foil Rotor | "Bump Rotor" | "Bulge Rotor" |
|---|---|---|---|
| Capacity t/d | 100 | 100 | 100 |
| Pressure Loss kPa | 45 | 37-32 | 29 |
| Change in Accept | | | |
| Consistency % | −0,2 | −0,15−−0,45 | +0,05 |
| Reject Ratio % | 8,3 | 7,5 | 6,4 |
| Rate of Change of Fractionation | 19,7 | 9,4–4,8 | <1.0 |

The consistency of the pulp used in the tests was 40% CTMP, 30% of bleached birch pulp, 30% of bleached pine pulp. The consistency was 3%.

As it can be seen in the table, a rotor with bulges in accordance with the invention is in every respect more practicable in such conditions where the operation of the process is to be reliable and control subsequent to the screen is difficult. For example, the power screen prior to the head box of a paper machine should not change the consistency of the accept and it should not change either the fraction distribution of the accept or the fraction distribution of the fed pulp. For example, for this use the bulge rotor can be applied much better than the other rotors in the comparison. If it is also taken into account that the real total capacity of the screen apparatus has risen with the new rotor by about 50 per cent there is no doubt that the screen apparatus in question could be applied also in any other application subjects characteristic of it.

EXAMPLE 2

In another test the behavior of the above described apparatus was with brown pine pulp, the consistency of which was in the test 3%. The screen cylinder was a perforated ($\phi$ 1.6 mm) slotted cylinder shown in FIG. 12. The comparison apparatus used in the test was the "bump rotor" according to the above described prior art. The results are shown in the table below by mentioning first the reference values of the "bump rotor".

| | | | |
|---|---|---|---|
| Accept Production t/d | 92 | 155 | |
| Tolerance of Pressure | | | |
| Difference kPa | 80 | 109 | |
| Purity 0.15 Sommerville | 0.12 | 0.07 | |
| Reduction of Shives % | | 78 | 83 |
| Thickening Coefficient accept | 0.58 | 0.97 | |

Thus it is to be noted that the productivity of a screen with a rotor according to the invention is approximately 60% higher than that of the apparatus of the prior art. The tolerance of pressure difference reflects mainly sensitivity of clogging, the lower the tolerance the easier the screen clogs. A clear difference is to be seen between the old arrangement and the new rotor in accordance with our invention. Furthermore, the shives reduction, in other words the relative amount of the shives separated with the screen of the total amount of the shives is somewhat better in our invention. The thickening coefficient (consistency of outlet pulp, accept, divided by consistency of the fed pulp) shows, how when using a bump rotor the consistency of the accept sank into almost half, in other words the accept diluted. The consistency of the accept with a rotor according to the invention remained practically the same as that of the fed pulp. Thus the rotor according to our invention operated in every respect more effectively than the "bump rotor" according to the prior art.

Referring to the above described example it must be stated that that the locations of the bulges used in it and the measures are only suggestive. The amount of bulges in different zones and the angles of deviation of their front surfaces from the axial direction can, of course, vary ±45° depending from the axial direction can, of course, vary on the pulp being treated, the rotational speed of the rotor, the clearance of the rotor and the screen cylinder, etc.

I claim:

1. Apparatus for treating fiber suspensions to separate an introduced suspension into fine and coarse suspension fractions, comprising:

an outer casing;

a stationary perforated screen cylinder, having perforations, disposed in said casing;

a counter surface having an axial length, and cooperating with said screen cylinder, said screen cylinder and said counter surface form a pair of cooperating elements;

means for rotating said counter surface about an axis in a direction of rotation;

said screen cylinder and counter surface mounted to define a space therebetween;

an inlet for introducing suspension into said space adjacent one end of said casing;

a discharge outlet for withdrawing coarse suspension that does not pass through said perforations, said outlet being adjacent an opposite axial end of said casing from said inlet;

means for withdrawing fine suspension which passes through said perforations from said casing;

means defining at least one projection on said counter surface, said projection having an axial length substantially the same as the axial length of said counter surface;

said projection having a leading, in the direction of rotation, surface means for subjecting suspension upon relative rotation of said projection to an axial force component the intensity of which varies as a function of the position of the suspension with respect to a line parallel to said axis, and which changes the direction and magnitude of the speed of the suspension as it flows in said space from said inlet to said discharge; and said projection surface means including a front surface upstanding from said counter surface, a surface substantially parallel to said counter surface, and a trailing end surface which tapers from said parallel surface to said counter surface.

2. Apparatus for treating fiber suspensions to separate an introduced suspension into fine and coarse suspension fractions, comprising:

an outer casing;

a stationary perforated screen cylinder, having perforations, disposed in said casing;

a counter surface cooperating with said screen cylinder, said screen cylinder and said counter surface form a pair of cooperating elements;

means for rotating said counter surface about an axis in a direction of rotation;

said screen cylinder and counter surface mounted to define a space therebetween;

an inlet for introducing suspension into said space adjacent one end of said casing;

a discharge outlet for withdrawing coarse suspension that does not pass through said perforations, said outlet being adjacent an opposite axial end of said casing from said inlet;

means for withdrawing fine suspension which passes through said perforations from said casing;

means defining a plurality of projections on said counter surface, each said projection having a leading, in the direction of rotation, surface means for subjecting suspension upon relative rotation of said projection to an axial force component the intensity of which varies as a function of the position of the suspension with respect to a line parallel to said axis, and which changes the direction and magnitude of the speed of the suspension as it flows in said space from said inlet to said discharge; and each said projection includes a non-axial front surface of said surface means upstanding from said counter surface and being divided into two different parts forming different angles with respect to a line parallel to said axis, a surface substantially parallel to said counter surface, and a trailing end surface which tapers from said parallel surface to said counter surface.

3. Apparatus as recited in claim 2 wherein each of the angles, with respect to a line parallel to said axis, of said front surface parts is greater than zero and less than about 45°.

4. Apparatus for treating fiber suspensions to separate an introduced suspension into fine and coarse suspension fractions, comprising:

an outer casing;

a stationary perforated screen cylinder, having perforations, disposed in said casing;

a counter surface cooperating with said screen cylinder, said screen cylinder and said counter surface form a pair of cooperating elements;

means for rotating said counter surface about an axis in a direction of rotation;

said screen cylinder and counter surface mounted to define a space therebetween;

an inlet for introducing suspension into said space adjacent one end of said casing;

a discharge outlet for withdrawing coarse suspension that does not pass through said perforations, said outlet being adjacent an opposite axial end of said casing from said inlet;

means for withdrawing fine suspension which passes through said perforations from said casing;

means defining a plurality of projections on said counter surface, each said projection having a leading, in the direction of rotation, surface means for subjecting suspension upon relative rotation of said projection to an axial force component the intensity of which varies as a function of the position of the suspension with respect to a line parallel to said axis, and which changes the direction and magnitude of the speed of the suspension as it flows in said space from said inlet to said discharge; and each said projection includes a non-axial front surface of said surface means a tan angle with respect to a line parallel to said axis which is greater than zero and less than about 45°, a surface substantially parallel to said counter surface, and a trailing end surface which tapers from said parallel surface to said counter surface.

5. Apparatus for treating fiber suspensions to separate an introduced suspension into fine and coarse suspension fractions, comprising:

an outer casing;

a stationary perforated screen cylinder, having perforations, disposed in said casing;

a counter surface having an axial length cooperating with said screen cylinder, said screen cylinder and said counter surface form a pair of cooperating elements;

means for rotating said counter surface about an axis in a direction of rotation;

said screen cylinder and counter surface mounted to define a space therebetween;

an inlet for introducing suspension into said space adjacent one end of said casing;

a discharge outlet for withdrawing coarse suspension that does not pass through said perforations, said outlet being adjacent an opposite axial end of said casing from said inlet;

means for withdrawing fine suspension which passes through said perforations from said casing;

means defining at least one projection on one of said screen cylinder and said counter surface, said projection having an axial length substantially the same as the axial length of said counter surface;

said projection having a leading surface means for subjecting suspension upon relative rotation of said projection to an axial force component the intensity of which varies as a function of the position of the suspension with respect to a line parallel to said axis, and which changes the magnitude of the speed of the suspension as it flows in said space from said inlet to said discharge; and said projection includes an upstanding front surface of said surface means, and a tapered trailing end surface.

6. Apparatus for treating fiber suspensions to separate an introduced suspension into fine and coarse suspension fractions, comprising:

an outer casing;

a stationary perforated screen cylinder, having perforations, disposed in said casing;

a counter surface cooperating with said screen cylinder, said screen cylinder and said counter surface form a pair of cooperating elements;

means for rotating said counter surface about an axis in a direction of rotation;

said screen cylinder and counter surface mounted to define a space therebetween;

an inlet for introducing suspension into said space adjacent one end of said casing;

a discharge outlet for withdrawing coarse suspension that does not pass through said perforations, said outlet being adjacent an opposite axial end of said casing from said inlet;

means for withdrawing fine suspension which passes through said perforations from said casing;

means defining a plurality of projections on one of said screen cylinder and said counter surface, each said projection having a leading surface means for subjecting suspension upon relative rotation of said projection to an axial force component the intensity of which varies as a function of the position of the suspension with respect to a line parallel to said axis, and which changes the magnitude of the speed of the suspension as it flows in said space from said inlet to said discharge; and each said projection includes an upstanding front surface of said surface means divided into two different parts forming different angles with respect to a line parallel to said axis, and a tapered trailing end surface.

7. Apparatus as recited in claim 6 wherein each of the angles, with respect to a line parallel to said axis, of said front surface parts is greater than zero and less than about 45°.

8. Apparatus for treating fiber suspensions to separate an introduced suspension into fine and coarse suspension fractions, comprising:

an outer casing;

a stationary perforated screen cylinder, having perforations, disposed in said casing;

a counter surface cooperating with said screen cylinder, said screen cylinder and said counter surface form a pair of cooperating elements;

means for rotating said counter surface about an axis in a direction of rotation;

said screen cylinder and counter surface mounted to define a space therebetween;

an inlet for introducing suspension into said space adjacent one end of said casing;

a discharge outlet for withdrawing coarse suspension that does not pass through said perforations, said outlet being adjacent an opposite axial end of said casing from said inlet;

means for withdrawing fine suspension which passes through said perforations from said casing;

means defining a plurality of projections on one of said screen cylinder and said counter surface, each said projection having a leading surface means for subjecting suspension upon relative rotation of said projection to an axial force component the intensity of which varies as a function of the position of the suspension with respect to a line parallel to said axis, and which changes the magnitude of the speed of the suspension as it flows in said space from said inlet to said discharge; and each said projection includes a front surface of said surface means at an angle with respect to a line parallel to said axis which is greater than zero and less than about 45°, and a tapered trailing end surface.

* * * * *